US005350333A

United States Patent [19]

Croyle

[11] Patent Number: 5,350,333

[45] Date of Patent: Sep. 27, 1994

[54] TOY DOLL

[76] Inventor: Noreen A. Croyle, 602 W. Fir - Unit 103, San Diego, Calif. 92101

[21] Appl. No.: 109,704

[22] Filed: Aug. 19, 1993

[51] Int. Cl.[5] ..... A63H 3/04

[52] U.S. Cl. ..... 446/370; 446/371; 446/374

[58] Field of Search ..... 446/370, 371, 369, 373, 446/374, 391, DIG. 901

[56] References Cited

U.S. PATENT DOCUMENTS

| | | | |
|---|---|---|---|
| 379,013 | 5/1921 | Goss | 446/371 |
| 954,544 | 4/1910 | Sanford . | |
| 1,581,382 | 4/1926 | Buchtrup . | |
| 2,219,130 | 10/1940 | Herrmann | 446/374 X |
| 2,997,810 | 8/1961 | Bellas . | |
| 3,310,907 | 3/1965 | Robbins . | |
| 3,699,715 | 10/1972 | Lewis | 446/371 |
| 4,296,553 | 10/1981 | Kamar | 446/369 |
| 4,526,553 | 7/1985 | Guerrero | 446/380 |
| 4,575,351 | 3/1986 | Gonzalez | 446/371 |
| 4,776,049 | 10/1988 | Perron | 5/436 |
| 4,884,991 | 12/1989 | Terzian | 446/369 |
| 4,964,836 | 10/1990 | Kamei | 446/370 X |
| 4,968,281 | 11/1990 | Smith | 446/369 |
| 5,083,966 | 1/1992 | Blank | 446/369 |
| 5,195,917 | 3/1993 | Russell et al. | 446/97 |

*Primary Examiner*—Mickey Yu
*Attorney, Agent, or Firm*—Jack C. Munro

[57] ABSTRACT

A toy doll which can be draped over an exterior structure and remain on that exterior structure during its period of usage. The toy doll can use the appendages of the doll as a further securing arrangement on the exterior structure. The head section of the doll is to be freely movable relative to the body section of the doll.

1 Claim, 1 Drawing Sheet

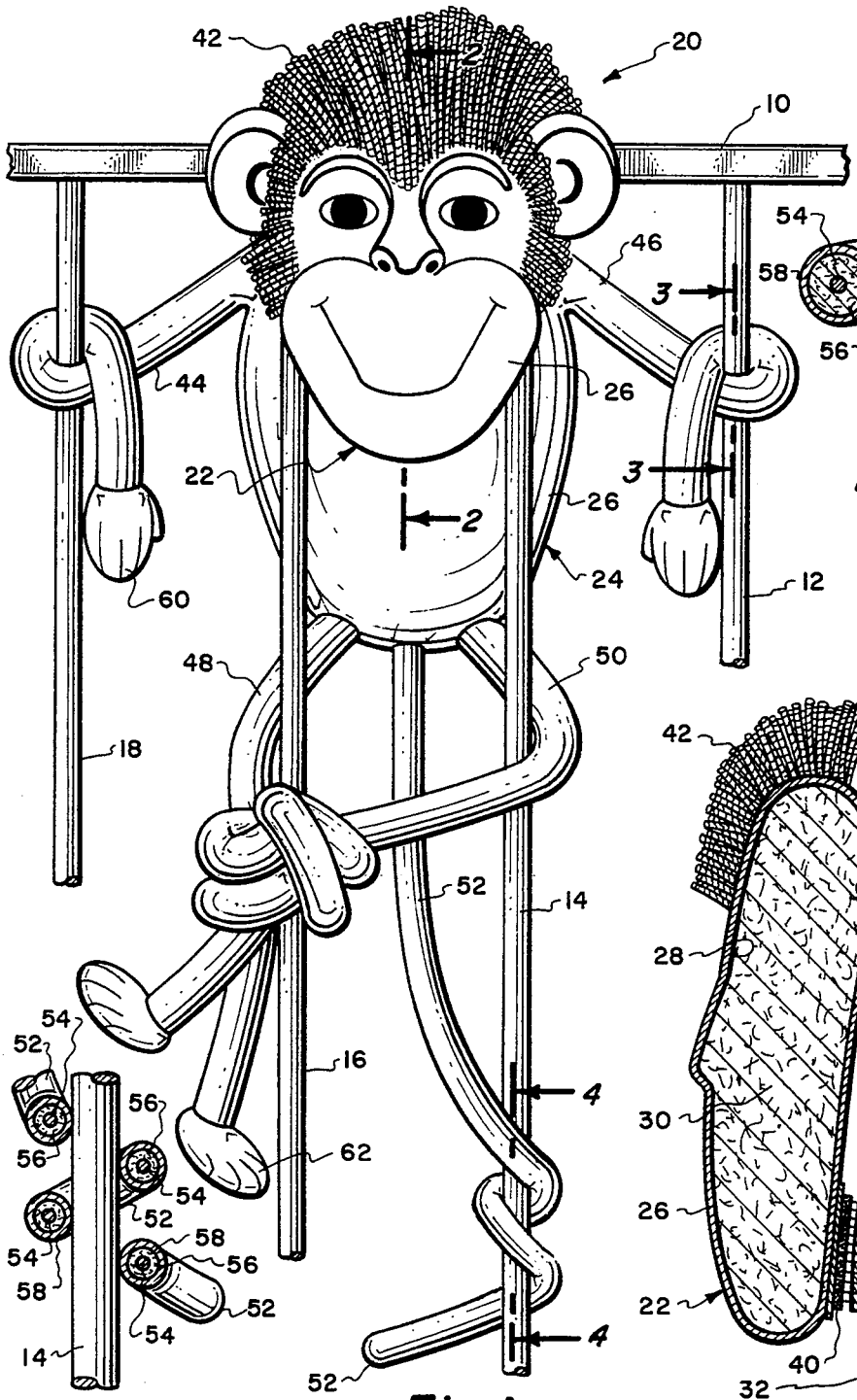
Fig. 1.
Fig. 4.
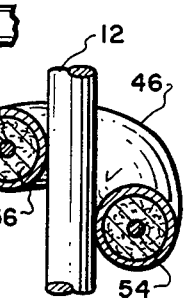
Fig. 3.
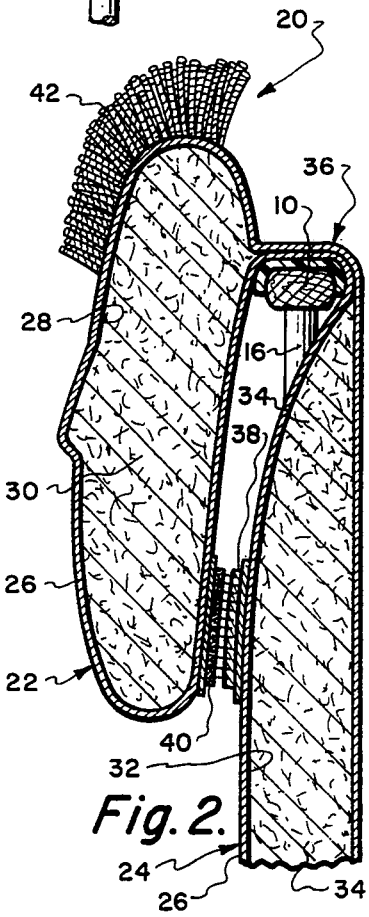
Fig. 2.

TOY DOLL

BACKGROUND OF THE INVENTION

1) Field of the Invention

The field of this invention relates to dolls and more particularly to a doll which is designed to be used with infants and toddlers, the doll being quickly and easily attachable to an exterior structure such as a crib.

2) Description of the Prior Art

One of the oldest and most endearing forms of toys are dolls. Dolls have been around in various forms for centuries and have been made in a wide variety of ways. There have been constructed dolls which facilitate attachment to an exterior structure. However, quick and easily attachment of a doll to an exterior structure in the manner of the present invention is not believed to have been known in the prior art.

SUMMARY OF THE INVENTION

A toy doll constructed of a head section and a body section with both the head section and the body section being formed of sheet material exterior layers of a flexible material such as fabric. Both the head section and the body section have an interior compartment within which is located a quantity of stuffing. A thin strip interconnects the head section and the body section with a thin strip being formed solely of the exterior layers and not including any stuffing. The thin strip is to be locatable upon an exterior structure such as a bar and be supported thereon with the head section and body section being located in juxtaposition. A fastener arrangement may be utilized between the head section and the body section when such are in juxtaposition. One or more appendages may be connected to the body section and/or the head section with these appendages being capable of being wrapped around an exterior structure and remain in that wrapped position or be wrapped together and remain in that wrapped position.

The primary objective of the present invention is to construct a toy doll which is to be supported on an exterior structure such as a wall or crib so as to locate the toy doll in close proximity to a human baby so as to function as an entertainment device for the baby.

Another objective of the present invention is to construct a toy doll which can be manufactured inexpensively and therefore sold to the ultimate consumer at an inexpensive price.

Another objective of the present invention is to construct a toy doll which can be quickly and easily mounted on an exterior structure to remain on that structure and to then function as an entertainment device for a child.

BRIEF DESCRIPTION OF THE DRAWINGS

FIG. 1 is a front view of a toy doll of the present invention designed as an animal and particularly a monkey showing the doll being connected to an exterior structure such as a side wall of a crib;

FIG. 2 is a transverse, cross-sectional view through the head section and body section of the doll of the present invention taken along line 2—2 of FIG. 1;

FIG. 3 is a cross-sectional view through one of the bars of the crib upon which has been secured an arm of the doll of the present invention; and FIG. 4 is a cross-sectional view taken through another bar of the crib showing the tail of the monkey being connected to this bar.

DETAILED DESCRIPTION OF THE SHOWN EMBODIMENT

Referring particularly to the drawing there is shown a side wall of a crib composed in part of a horizontal top bar 10 from which extends in an even spaced apart manner a plurality of vertical bars 12, 14, 16, and 18. Typically the bars 10, as well as bars 12, 14, 16, and 18, will be constructed of a wood material. However, any rigid material could be utilized.

The doll 20 of this invention is composed generally of a head section 22 and a body section 24. The head section 22 and the body section 24 is constructed in the same manner having an exterior layer 26 constructed of sheet material. The layer 26 will normally be a fabric or other similar type of flexible material. The layer 26 of the head section 22 forms a totally enclosed compartment 28. Within the compartment is a quantity of a stuffing 30. Any desirable stuffing material could be utilized which could be a plastic, cotton or other similar type of wadding.

The layer 26 of the body section 24 also forms a totally closed compartment 32 with it being filled with a stuffing 34. The layers 26 between the head section 22 and the body section 24 connect together forming a strip 36. The strip 36 is about one and one half inches long and will normally be formed by the layers 36 being sewn together or adhered together in some other similar manner.

The strip 36 is to be placed on the bars 10. When doing so the head section 22 will be located along the front side of the bar 10 with the body section 24 located along the back side of the bar 10. It is to be noted that the head section 22 can be moved relative to the body section 24 to any desired location. In other words the head section could be flopped over and instead of being located adjacent the front surface of the body section 24, it could be located adjacent the back surface of the body section 24.

Fixedly mounted on the front surface of the body section 24 is a pad 38 which includes a mass of tiny hooks. These hooks are to lockingly engage with a mass of tiny eyelets which are formed within a pad 40 which is fixedly mounted on the back surface of the head section 22. Engagement between the pads 38 and 40 functions as a fastening device to retain the doll in position on the bar 10. It is to be understood that a mere draping of the doll 20 of this invention on the bar 10 will function to secure into position the doll 10 with the weight of the head section 22 and the weight of the body section 24 essentially counterbalancing the doll 20 and maintaining such in position on the bar 10 even if the fastener composed of pads 38 and 40 was not utilized.

Normally the head section 26 will be configured to be in some form of a design such as the face as shown and including a series of upstanding threads 42 which is to resemble hair. Connected to the body section 24 are a plurality of appendages with these appendages comprising a right arm 44, a left arm 46, a right leg 48, a left leg 50 and a tail 52. Each of the appendages is constructed in the same manner, that being elongated having a centrally located wire rod 54 which is encased by a small amount of stuffing 56 and which is covered by an exterior layer of fabric 58. Basically each of the appendages is in the shape of a thin cylinder. Each appendage may end in an appropriate configuration such as a hand 60 or a foot 62.

Each of the appendages, because of the wire rod 54, is capable of being bent into any desired configuration and will remain in that configuration. Therefore, the arms 44 and 46 can be bent around their respective vertical bars 18 and 12. In a similar manner the tail 52 is shown being wound around the vertical rod 14. The legs 48 and 50 are shown as extending around their respective vertical rods 16 and 14 with the legs 48 and 50 being wound together. This securing arrangement of the appendages additionally provides a securement to the exterior structure preventing accidental dislodgement by the infant or toddler.

It is to be understood that the securing arrangement utilizing the appendages may or may not be utilized especially if securing pads 38 and 40 are used. It is possible that the particular toy doll 20 would be designed to not even have any appendages. Also, it is considered to be in the scope of this invention that if the appendages are used, there may not be used the pads 38 and 40.

What is claimed is:

1. A toy doll constructed of a thin, sheet material, flexible, exterior layer which has a plurality of interior closed compartments, said toy doll comprising:

a body section having at least one said interior closed compartment filled with a stuffing;

a head section having at least one said interior closed compartment filled with said stuffing;

a strip connecting said head section and said body section, said strip permitting independent movement of both said head section and said body section relative to said strip, said strip is adapted to be located on an exterior bar structure with both said head section and said body section being dropped downwardly by gravity assuming a juxtaposed position, said strip being composed of a plurality of directly joined layers, each of said layers comprising said exterior layer;

a plurality of appendages being connected to said body section, each one of said appendages including a bendable wire rod that permits wrapping of each of said appendages around an exterior structure and also intertwining of said appendages together in an overlapping, wound together, configuration, said bendable wire rod of each one of said appendages to remain in its wrapped configuration until manually unwrapped;

a fastener arrangement connecting said head section to said body section when in said juxtaposition, said fastener arrangement being spaced from said strip.

* * * * *